US008018175B2

(12) United States Patent
Chung

(10) Patent No.: US 8,018,175 B2
(45) Date of Patent: Sep. 13, 2011

(54) LED REGULATION CIRCUIT AND METHOD

(75) Inventor: Chin-Biau Chung, Taipei Hsien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 456 days.

(21) Appl. No.: 12/203,624

(22) Filed: Sep. 3, 2008

(65) Prior Publication Data

US 2010/0052573 A1 Mar. 4, 2010

(51) Int. Cl.
*H05B 41/16* (2006.01)

(52) U.S. Cl. ..... 315/246; 315/291; 315/360

(58) Field of Classification Search ..... 315/209 R, 315/246, 291, 307, 360
See application file for complete search history.

(56) References Cited

U.S. PATENT DOCUMENTS 5,995,381 A * 11/1999 Wakamatsu ..... 363/16
6,396,718 B1 * 5/2002 Ng et al. ..... 363/21.07
2007/0109328 A1 * 5/2007 Lewis ..... 345/691
2010/0013409 A1 * 1/2010 Quek et al. ..... 315/294

* cited by examiner

*Primary Examiner* — Thuy Vinh Tran
(74) *Attorney, Agent, or Firm* — Muncy, Geissler, Olds & Lowe, PLLC

(57) ABSTRACT

An LED regulation circuit and method include a voltage transformation unit to receive DC power and provide a constant current to drive at least one LED and a pulse-width modulation unit to generate a driving signal to control the voltage transformation unit. The driving signal of the pulse-width modulation unit has an operation period. In the operation period, the driving signal drives the voltage transformation unit to output regular operation power. The pulse-width modulation unit is connected to a timing regulation unit which generates a regulation signal sent to the pulse-width modulation unit to regulate the operation period of the driving signal by adding a sleep period. In the sleep period, the driving signal lowers the power of the voltage transformation unit that drives the LED. Through alternately controlling the operation period and sleep period of the driving signal, continuous heat generation and heat accumulation can be reduced.

10 Claims, 4 Drawing Sheets

LED REGULATION CIRCUIT AND METHOD

FIELD OF THE INVENTION

The present invention relates to a regulation circuit and method for electronic devices and particularly to an LED (light emitting diode) regulation circuit and method.

BACKGROUND OF THE INVENTION

LED provides many advantages over conventional lighting features such as a higher efficiency, longer life span and less likely to be damaged, thus is widely used in people's daily life nowadays. However, due to the LED is driven by a front end DC power supply to generate light and the DC power supply outputs a high current in a constant current mode as shown in FIG. 6, the LED receives the high current continuously. As a result, aside from generating light, a great amount of heat also is generated. The heat is accumulated and could result in overheated and malfunction of the LED. The fluorescent powder used on white light LEDs also could be degraded under heat and result in change of light color. All this seriously affects the brightness and durability of the LED.

In order to disperse the heat of the LED when in use, the general approach is mounting an LED chip set onto a metal seat. The metal seat is connected to a radiation metal blade to disperse heat. However, when the LED is in a high current duty condition, heat dissipation efficiency often is not desirable and results in heat accumulation and forming hot spots. This could cause burned down of the LED. A conventional technique to attack this problem is installing radiation fins and even an air fan outside an LED module to provide more cooling power. As the power of LED increases constantly in recent years, the size of composite products also increases. The conventional technique mentioned above becomes a constraint to LED product design and production process. Improvements are needed to resolve those problems.

SUMMARY OF THE INVENTION

The primary object of the present invention is to reduce heat generated by LEDs during operation to prevent excessive heat accumulation resulting in decreasing of life span and brightness, and also reduce installation of cooling elements to simplify total structure of the LEDs.

To achieve the foregoing object, the invention provides an LED regulation circuit which includes a voltage transformation unit to receive DC power and provide a constant current to drive at least one LED and a pulse-width modulation unit to generate a driving signal to control the voltage transformation unit. The driving signal has an operation period. In the operation period, the driving signal drives the voltage transformation unit to output regular operation power. The pulse-width modulation unit also is connected to a timing regulation unit which generates a regulation signal sent to the pulse-width modulation unit to regulate the driving signal by adding a sleep period in the operation period. In the sleep period, the driving signal lowers the power of the voltage transformation unit that drives the LED. Through alternately switching of the operation period and sleep period of the driving signal, heat accumulation of the LED can be prevented during continuous operation.

In one aspect, the sleep period is less than 1/16 second. The voltage transformation unit is electrically connected to a rectification filter circuit. The rectification filter circuit includes a rectification unit and a filter unit. The rectification filter circuit receives AC power from an AC power source and transforms to DC power output to the voltage transformation unit. The driving signal generated by the pulse-width modulation unit is a pulse-width modulation signal. The voltage transformation unit outputs non-zero current power. The timing regulation circuit and pulse-width modulation unit are bridged by a coupler unit. The timing regulation unit further has a comparator and a clock generator. The comparator gets a standard signal from the regulation circuit and a clock signal from the clock generator, and determines generation of the regulation signal according to output frequency of the clock signal.

Furthermore, the invention provides a regulation method of the aforesaid regulation circuit adaptable to DC power driving circuits. The method includes procedures as follow:

a. output a driving signal with an operation period to a voltage transformation unit;

b. drive the voltage transformation unit to provide a regular operation current to at least one LED;

c. regulate the operation period of the driving signal by adding a sleep period; and d. lower the regular operation current of the LED driven by the voltage transformation unit according to the driving signal in the sleep period to prevent heat accumulation of the LED during continuous operation.

In one aspect, another step of determining to add a sleep period interval frequency is included. The sleep period is less than 1/16 second. The power output by the voltage transformation unit has non-zero current.

In another aspect, in the LED regulation circuit and method set forth above, the driving power output from the voltage transformation unit to the LED can be changed according to the operation period and sleep period of the driving signal output from the pulse-width modulation unit to prevent the LED at the rear end from continuously receiving the regular driving power and accumulating heat and resulting in damage and a shorter life span of the LED. Thus cooling of the LED can be effectively accomplished without installing radiation elements. And production and assembly of the LED devices can be done easier and more efficiently.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
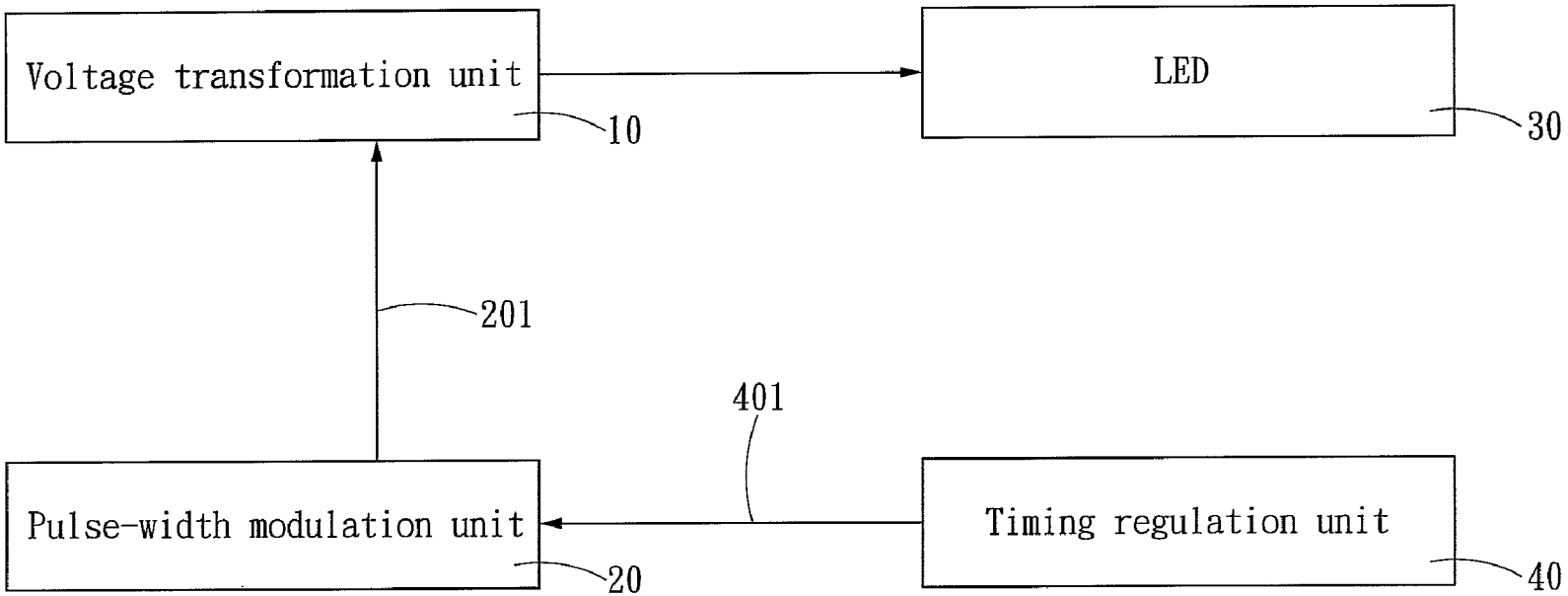
FIG. 1 is a circuit block diagram of an embodiment of the LED regulation circuit of the invention.

Please refer to FIG. 1 for the circuit block diagram of an embodiment of an LED regulation circuit of the invention. The regulation circuit includes a voltage transformation unit 10 to receive DC power and provide a constant current to drive at least one LED 30 and a pulse-width modulation unit 20 to generate a driving signal 201 to control the voltage transformation unit 10. The pulse-width modulation unit 20 is connected to a timing regulation unit 40 to receive a regulation signal 401 generated thereof.

Figure 2:
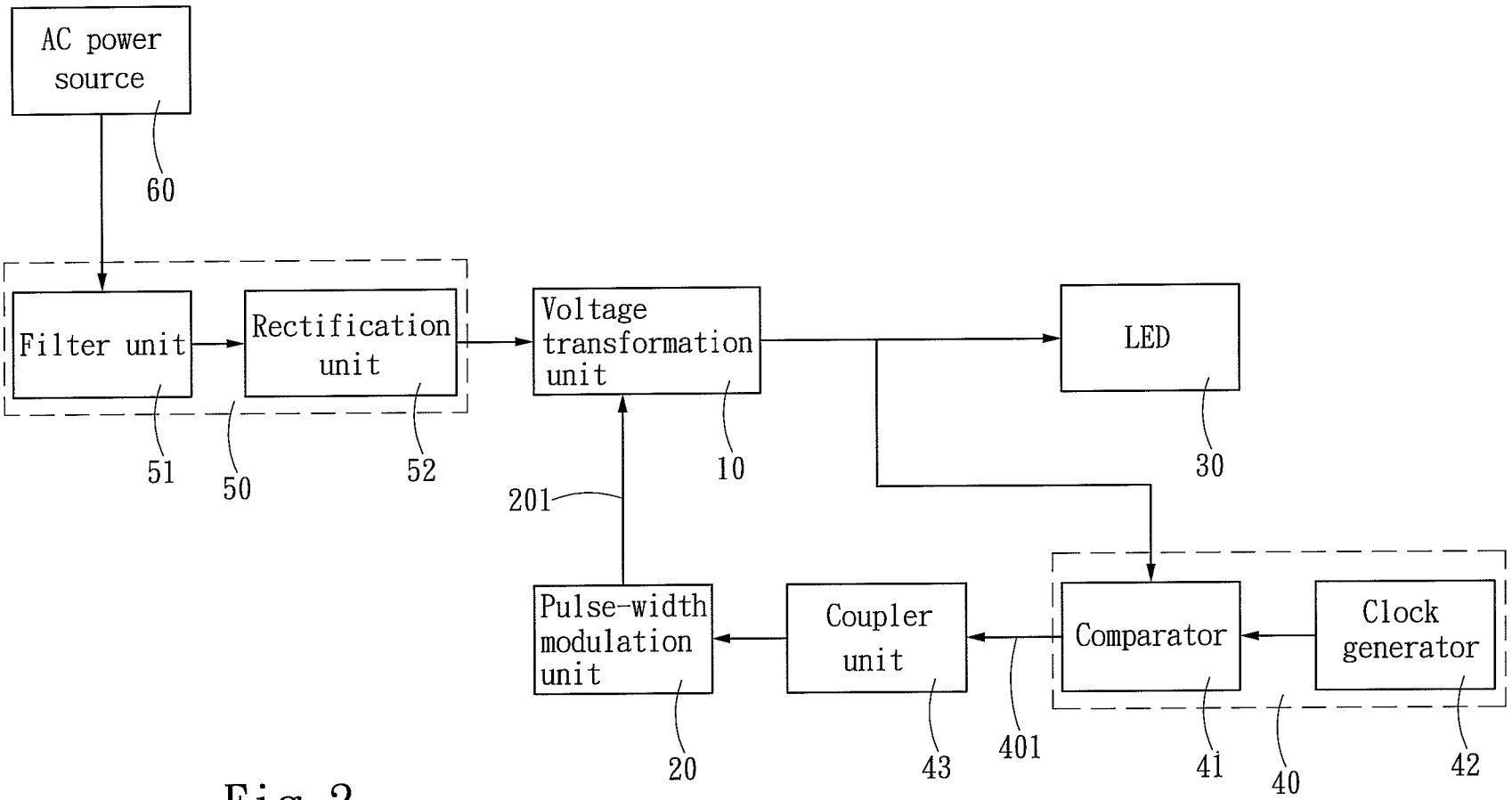
FIG. 2 is a circuit block diagram of another embodiment of the LED regulation circuit of the invention.

Refer to FIG. 2 for the circuit block diagram of another embodiment of the invention. The voltage transformation unit 10 is electrically connected to a rectification filter circuit 50 to receive AC power from an AC power source 60 (such as city power) and transform to DC power sending to the voltage transformation unit 10. The rectification filter unit 50 includes a filter unit 51 (such as an EMI filter) and a rectification unit 52. The timing regulation unit 40 has a comparator 41 and a clock generator 42. In this embodiment, the comparator 41, the clock generator 42 and a coupler unit 43 are located at the secondary side of the voltage transformation unit 10 to regulate the DC power output from the voltage transformation unit 10. The comparator 41 has an input end electrically bridged the voltage transformation unit 10 and the LED 30, and another input end electrically connected to the clock generator 42, and an output end electrically connected to the coupler unit 43 which is also electrically connected to the pulse-width modulation unit 20. In this embodiment, the timing generator 42 outputs a clock signal at a selected frequency to the comparator 41. The comparator 41 compares the clock signal with a standard signal obtained from a rear end circuit of the voltage transformation unit 10, then the timing regulation unit 40 outputs the regulation signal 401 according to the selected frequency through the coupler unit 43 to the pulse-width modulation unit 20.

Figure 3:
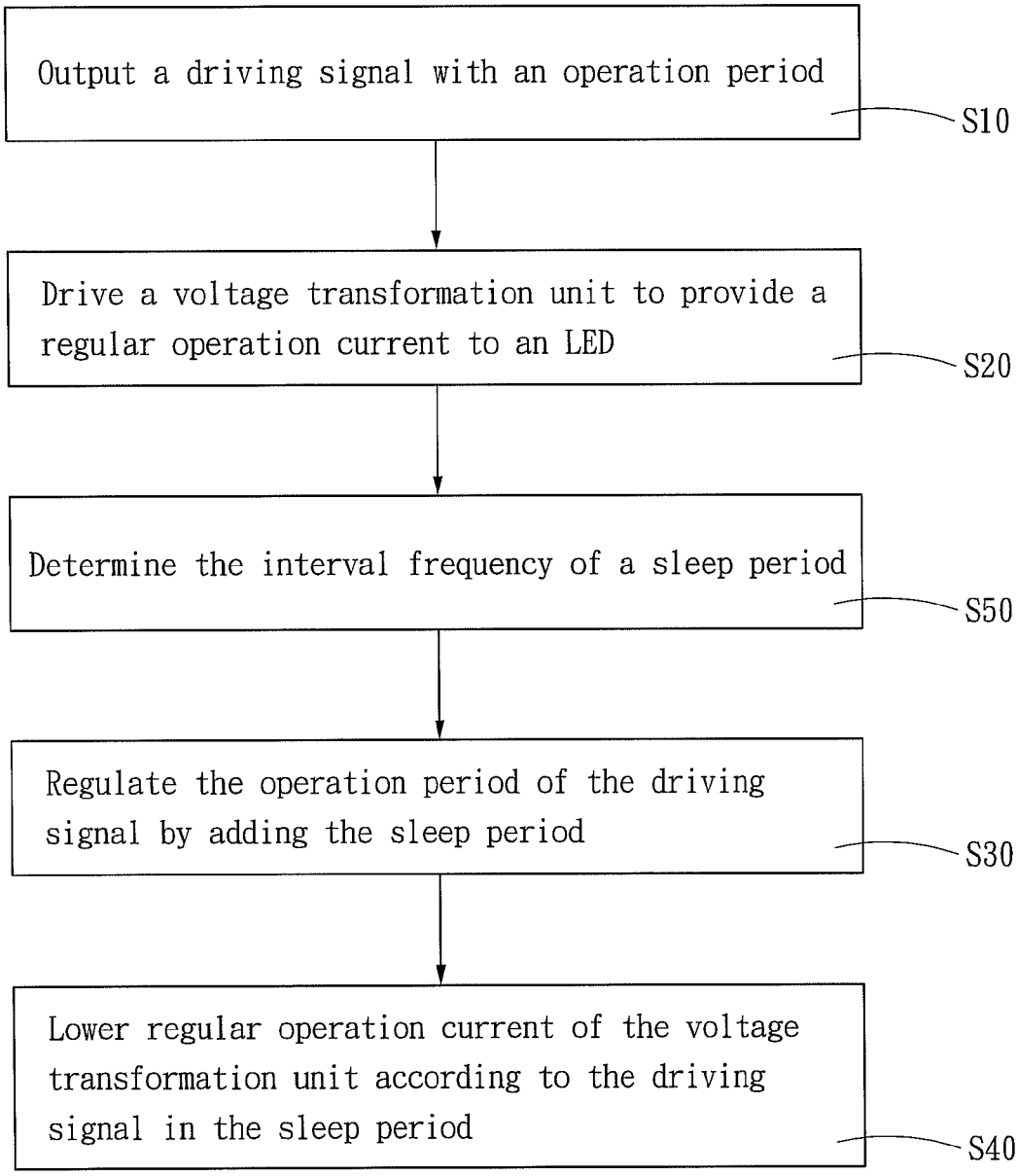
FIG. 3 is a flowchart of an embodiment of the LED regulation method according to the invention.

The invention further provides a regulation method adaptable to the aforesaid regulation circuit. Refer to FIG. 3 for the flowchart of an embodiment of the method adopted for a DC power driving circuit. It includes procedures as follow:

a. output a driving signal with an operation period to a voltage transformation unit (S10);

b. drive the voltage transformation unit to provide a regular operation current to at least one LED (S20);

c. regulate the operation period of the driving signal by adding a sleep period (S30); and d. lower the regular operation current of the LED driven by the voltage transformation unit according to the driving signal in the sleep period to prevent heat accumulation of the LED during continuous operation (S40).

The procedures set forth above further include a step of determining to add a sleep period interval frequency. At this step, the interval of the sleep period can be determined through a clock signal output by a selected frequency. In general, the sleep period is less than 1/16 second to prevent flickering of the LED. The voltage transformation unit outputs power with non-zero current.

Figure 4:
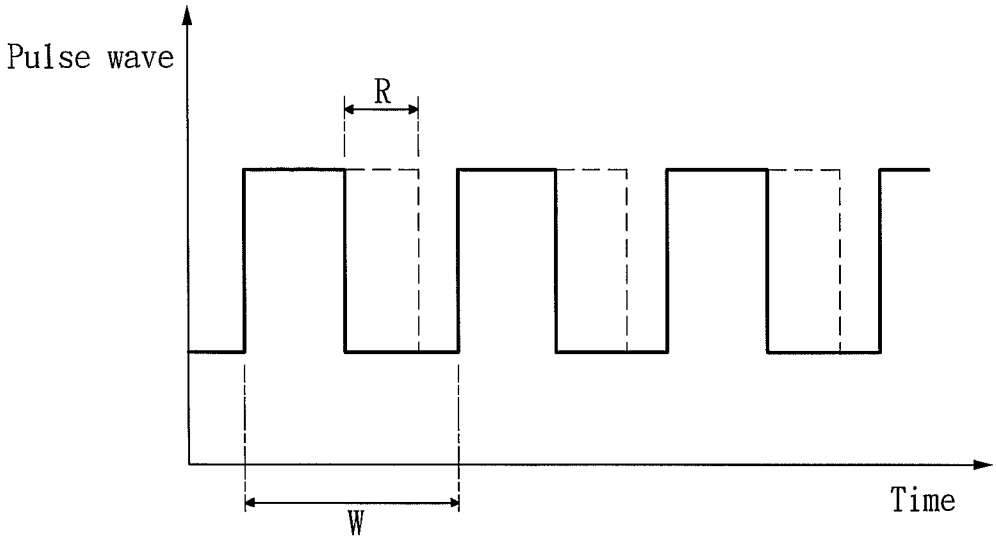
FIG. 4 is a schematic view of an embodiment of the pulse wave period according to the invention.
Figure 5:
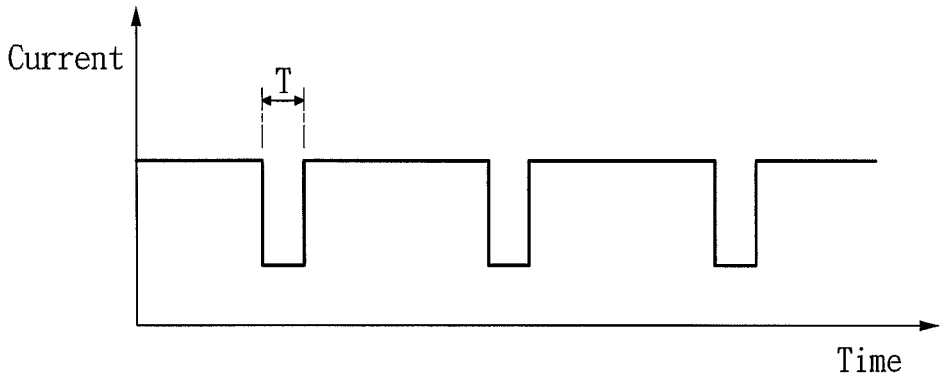
FIG. 5 is a schematic view of an embodiment of power output according to the invention.
Figure 6:
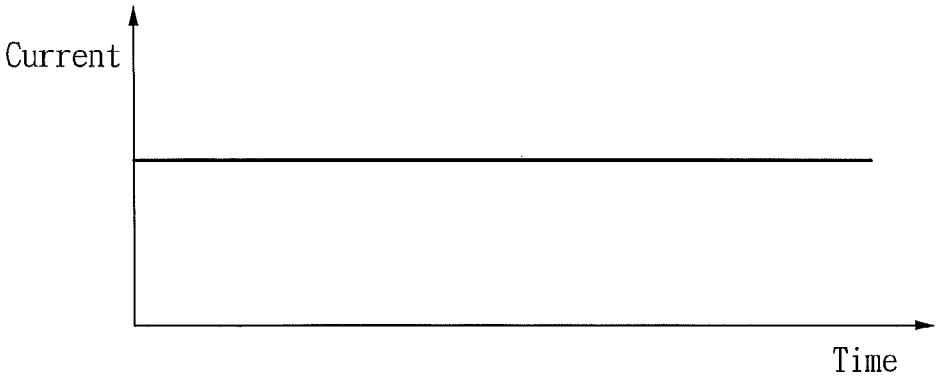
Fig. 6 PRIOR ART
FIG. 6 is a schematic view of power output supplying to a conventional LED.

Refer to FIG. 4 for a schematic view of an embodiment of the pulse wave period of the driving signal according to the invention. Also referring to FIGS. 2 and 3, the pulse-width modulation unit 20 in the regulation conditions generates the driving signal 201 with an operation period W. The driving signal 201 is a pulse-width modulation signal and contains at least one pulse wave generation time in the operation period W. The pulse-width modulation unit 20 is electrically connected to a control switch 21. In the pulse wave generation time, the control switch 21 establishes electric connection between the rectification filter circuit 50 and the voltage transformation unit 10 so that the voltage transformation unit 10 receives the DC power transformed by the rectification filter circuit 50 to change voltage and provide a desired constant current to drive the LED 30 at a rear end. The pulse-width modulation unit 20 is connected to the timing regulation unit 40 as shown in FIGS. 2 and 3. The comparator 41 of the timing regulation unit 40 receives a standard signal from a rear end of the voltage transformation unit 10 in the regular conditions. The timing regulation unit 40 further has the clock generator 42 which electrically connected to the comparator 41 to output the clock signal at a selected frequency to the comparator 41. The comparator 41 compares the clock signal and standard signal so that the timing regulation unit 40 can determine to generate the regulation signal 401. The regulation signal 401 is sent to the pulse-width modulation unit 20 to regulate the operation period W of the driving signal 201 by adding a sleep period R. Hence the duration of pulse wave generation in the driving signal 201 is reduced. As the control switch 21 receives the driving signal 201 with a shorter pulse wave generation duration, connection period of the rectification filter circuit 50 and voltage transformation unit 10 also is shorter. As a result, referring to FIG. 5, the duration of the voltage transformation unit 10 receiving the DC power from the rectification filter circuit 50 also is shorter. And an idle time T is formed when the voltage transformation unit 10 transforms the driving power. During the idle time T, the driving power delivers current at a smaller amount than the regular driving power. In this embodiment, the driving power has non-zero current in the idle time T. Thus by providing alternate operation period W and sleep period R in the driving signal 201, heat accumulation of the LED 30 during continuous operation that might otherwise occur can be prevented.

As a conclusion, the LED regulation circuit and method of the invention adding the sleep period in the operation period of the driving signal to shorten DC power supplying time of the voltage transformation unit received from the rectification filter circuit. Thus the driving power provided by the voltage transformation unit to the rear end LED is altered, and the LED goes through the idle period at a lower current without continuously receiving the driving power at a higher current. Therefore, heat accumulation that might otherwise occur by continuous operation of the LED can be prevented and life span of the LED increases. Moreover, the regulation circuit and method of the invention need less conventional radiation elements to perform cooling. Production of the LED devices can be done easier and more efficiently. It offers a great improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An LED regulation circuit having a voltage transformation unit to receive DC power and provide a constant current to drive at least one LED and a pulse-width modulation unit to generate a driving signal to control the voltage transformation unit, comprising:

the driving signal of the pulse-width modulation unit has an operation period to drive the voltage transformation unit to output power for regulation operation, the pulse-width modulation unit being connected to a timing regulation unit which generates a regulation signal sent to the pulse-width modulation unit to regulate the operation period of the driving signal by adding a sleep period in which the driving signal lowers the power of the voltage transformation unit that drives the LED such that the operation period and the sleep period in the driving signal take place alternately to prevent the LED from accumulating heat during continuous operation;

the timing regulation unit having a comparator and a clock generator, the comparator having an input end electrically bridged the voltage transformation unit and the LED, and the other input end electrically connected to the clock generator.

2. The LED regulation circuit of claim 1, wherein the voltage transformation unit is electrically connected to a rectification filter circuit.

3. The LED regulation circuit of claim 1, wherein the timing regulation unit and the pulse-width modulation unit are bridged by a coupler unit.

4. The LED regulation circuit of claim 1, wherein the driving signal is a pulse-width modulation signal.

5. The LED regulation circuit of claim 1, wherein the power output by the voltage transformation unit has a non-zero current.

6. The LED regulation circuit of claim 1, wherein the sleep period is less than 1/16 second.

7. An LED regulation method for a DC power driven circuit, comprising the steps of:

delivering a driving signal containing an operation period to a voltage transformation unit from a timing regulation unit having a comparator and a clock generator, the comparator having an input end electrically bridged the voltage transformation unit and the LED, and the other input end electrically connected to the clock generator;

driving the voltage transformation unit to provide a regular operation current to at least one LED;

regulating the operation period of the driving signal by adding a sleep period; and lowering the regular operation current from the voltage transformation unit that drives the LED according to the driving signal in the sleep period to prevent the LED from accumulating heat during continuous operation.

8. The LED regulation method of claim 7 further including a step of determining to add a sleep period interval frequency.

9. The LED regulation method of claim 7, wherein the sleep period is less than 1/16 second.

10. The LED regulation method of claim 7, wherein the current output by the voltage transformation unit is a non-zero current.

* * * * *